United States Patent [19]

Freres

[11] Patent Number: 4,823,661

[45] Date of Patent: Apr. 25, 1989

[54] DIE ASSEMBLY FOR PUNCHING HOLES IN PAPER

[75] Inventor: Donald E. Freres, Racine, Wis.

[73] Assignee: Sterling Tool Co., Racine, Wis.

[21] Appl. No.: 137,056

[22] Filed: Dec. 23, 1987

[51] Int. Cl.[4] ..... B26F 1/14

[52] U.S. Cl. ..... 83/146; 83/169; 83/467 R; 83/620; 83/687; 83/689; 83/824

[58] Field of Search ..... 83/145, 146, 556, 635, 83/640, 620, 699, 687, 686, 689, 821, 824, 169, 599, 467 R

[56] References Cited

U.S. PATENT DOCUMENTS

| | | | |
|---|---|---|---|
| Re. 17,905 | 12/1930 | Wright | 83/146 |
| 395,320 | 1/1889 | Fish | 83/689 X |
| 2,017,195 | 10/1935 | Anderson et al. | 83/146 |
| 3,362,271 | 1/1968 | Willis | 83/146 |
| 3,504,588 | 4/1970 | Thomas | 83/689 X |
| 3,656,394 | 4/1972 | McCutcheon | 83/689 |
| 4,240,314 | 12/1980 | Teeslink | 83/635 |
| 4,257,300 | 3/1981 | Muzik | 83/687 X |
| 4,635,513 | 1/1987 | McGeehee | 83/821 X |

*Primary Examiner*—Frank T. Yost
*Assistant Examiner*—Rinaldi Rada
*Attorney, Agent, or Firm*—James E. Nilles; Thomas F. Kirby

[57] ABSTRACT

A die assembly for mounting in a die press operates to punch a row of holes in a stack of paper sheets in response to a single press stroke. The die assembly comprises a stationary lower die block having a row of die holes therethrough, one or more lubricated stationary guide plates each having a row of guide holes therethrough and located above and spaced from the die block by a separator plate so as to define a stack-receiving slot, a reciprocably movable punch retainer assembly located above the guide plate and a row of elongated, downwardly-depending punches connected at their head ends to the punch retainer assembly which extend through and slidably engage the guide holes. When the press closes, the cutting ends of the punches move through the stack-receiving slot and through a stack of sheets therein into sliding engagement with the die holes. When the press opens, the punches are withdrawn clear of the stack-receiving slot. The head end of each punch is connected to the punch retainer assembly so that it can "float" (i.e. shift axially and/or shift transversely for very small distances). The "float" enables the guide holes in the guide plate(s) to maintain the cutter end so the punches in precise alignment with the die holes. The head end of each punch is also connected to the punch retainer assembly so as to prevent the punches from being axially disengaged from the punch retainer assembly during press operation and from rotating relative to the punch retainer assembly. The cutting end of each punch has a pair of spaced apart cutting edges separated by an indented surface which bears against the stack during a cutting operation.

8 Claims, 3 Drawing Sheets

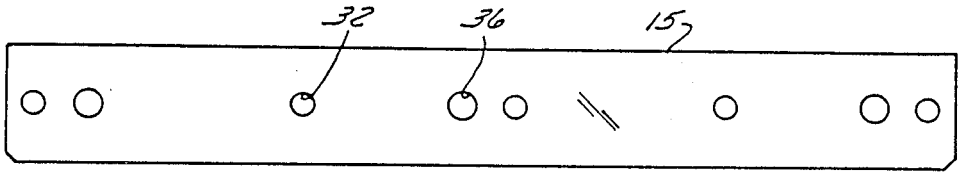
FIG. 6
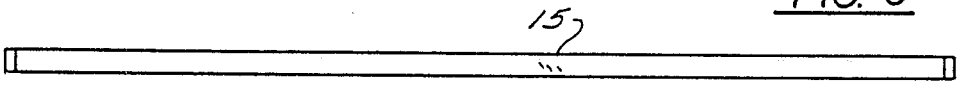
FIG. 7
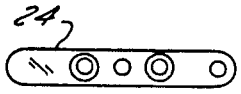
FIG. 8
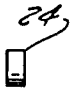
FIG. 9
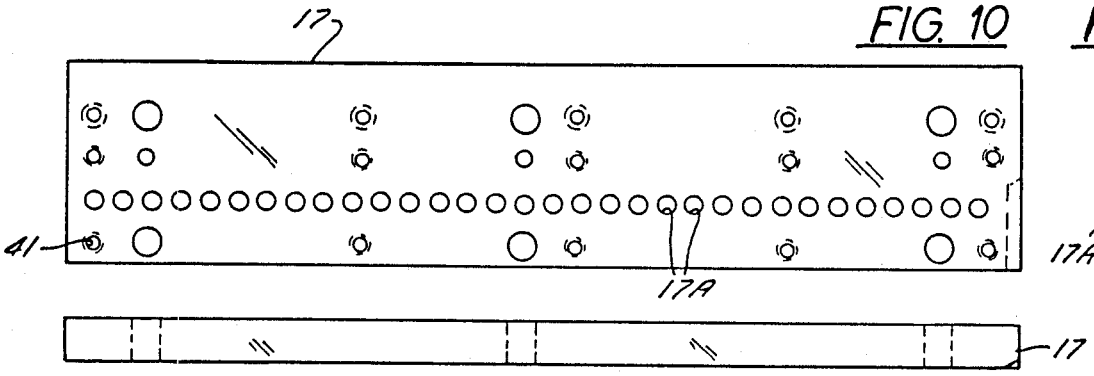
FIG. 10
FIG. 11
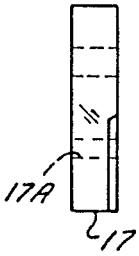
FIG. 12
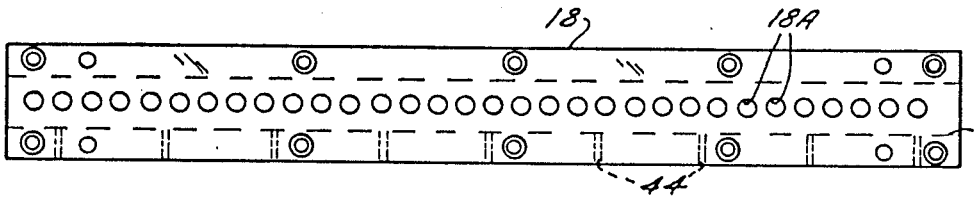
FIG. 13
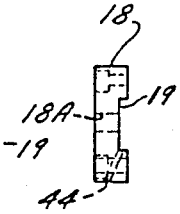
FIG. 14

DIE ASSEMBLY FOR PUNCHING HOLES IN PAPER

BACKGROUND OF THE INVENTION

1. Field of Use

This invention relates generally to die assemblies for punching holes through stacks of paper sheets. In particular, it relates to improvements in the construction and mode of operation of such die assemblies and components therefor.

2. Description of the Prior Art

Some publications and notebooks comprise a plurality of paper sheets arranged in a stack, front and back paperboard covers at opposite end faces of the stack and a spiral binder, in the form of a metal or plastic helical coil, which is threaded through a row of closely spaced holes provided along an edge of the the stack and along the corresponding edges of the covers.

One step in the manufacture of such publications and notebooks involves insertion of the stack of sheets in a die assembly in a die press and operating the latter to punch a row of holes in the stack. The die assembly, which typically comprises a stationary die block with a row of die holes therein and a relatively movable punch retainer plate, supporting a row of elongated steel punches, which is detachably mounted on the frame of the die press. The punch retainer plate and the punches thereon are reciprocably moved as a unit relative to the die block by a movable drive member on the press between open and closed positions. The drive member is motor-driven or, in the case of small presses, manually operated.

The die assembly typically comprises four principal components, namely: the aforementioned stationary lower die block, a stationary guide plate located above and spaced from the die block by a stationary separator plate, the aforementioned reciprocably movable upper punch retainer plate which is located above the guide plate, and the aforementioned row of downwardly extending punches which are rigidly secured to and movable with the punch retainer plate. The space between the lower die block and the guide plate serves as a stack-slot which is adapted to receive the edge of a stack of paper sheets which is to have a row of holes punched therethrough. The die block, guide plate and punch retainer plate are each provided with a row of die holes, guide holes and punch-retainer holes, respectively. The punch retainer holes are part of a means for fixedly securing the punches on the punch retainer plate. The guide holes guide the punches into alignment with the die holes. The die holes cooperate with the punches as the stack is pierced and serves as an exit for punched-out paper scraps. Each hole corresponds in shape to the transverse cross-sectional configuration of the punch receivable therein which, for example, may be round, retangular or any other desired configuration, depending on the desired punched hole shapes for the stack. Each punch extends downwardly through and is slidably engaged by a registering guide hole in the guide plate. The lower cutting end of each punch is reciprocably movable through the stack-slot (and through any stack therein) and through a registering die hole in the die block as the punch retainer plate and punch thereon are reciprocably moved by the drive member of the press.

In one cycle of operation, the upper punch retainer plate and punches thereon are initially in open or raised position. The edge of a stack of paper sheets is inserted into the stack-slot. Then, the press is operated so that its drive member moves the upper punch retainer plate and punches thereon downwardly as a unit to closed position. As this occurs, the row of punches penetrate the stack and form a row of holes therein. The cutting ends of the punches then enter and slidably engage the row of die holes in the lower die block to effect expulsion of the punched-out pieces of paper through the open lower ends of the die holes. Thereafter, the drive member moves the upper punch retainer plate and punches thereon upwardly as a unit to open position so that the punches retract into the guide holes and are clear of the stack-slot so that the punched stack can be removed from the stack-slot, whereupon the die assembly and press are in readiness for the next cycle of operation.

Prior art die assemblies of the aforesaid character are subject to considerable wear in the course of prolonged, repetitious, high-speed operation. Therefore, they require relatively frequent and costly maintenance, servicing and component replacement. Most wear occurs at the cutting ends of the punches, at the upper end of the row of die holes in the die block and in the guide holes in the guide plate. The cutting edges of the punches must be periodically sharpened by regrinding (which gradually reduces their original length), as do the upper edges of the die holes, although not as often as the punches (a typical ratio for service being about 5 to 1). In prior art die assemblies wear is attributable to the particular design of the die assembly and to the particular methods of manufacture of the components thereof. However, efforts aimed at avoiding or mitigating certain wear problems have resulted in die assembly designs which merely substitute one set of problems and remedial procedures for another, with no net reduction in maintenance, service and component replacement costs.

For example, during manufacture of some prior art die assemblies, in an effort to reduce the number of individual hole drilling operations, the metal blanks for the die block, guide plate and punch retainer plate are stacked one on top of the other, clamped together and then drilled, using one or more drill bits. In this arrangement, each drill bit forms a set of three holes, each set including a die hole, guide hole and punch-retainer hole. However, this attempt at production efficiency has the following drawbacks. First, the drill bit tends to bend and then slant as it cuts into blanks (which are typically made of different metals) and cannot be maintained precisely perpendicular to the blanks. As a result, the holes in a set are slightly misaligned from each other when drilled and this misalignment becomes amplified when the three plates are mounted in spaced-apart relationship in the finished die assembly. Second, each set of holes cannot be drilled so as to be precisely parallel to an adjacent (or other) set of holes. Therefore, further random misalignment results, which is also exagerated when the plates are spaced apart in the finished die assembly. The end result is that each punch rigidly and fixedly installed in a punch-retainer hole may itself be slanted and, in most cases, is not precisely aligned with its associated guide hole and die hole. This causes substantial wear during die operation.

Attempts to overcome this problem of misalignment involved fabrication of the guide plate of relatively soft metal, such as bronze, to reduce friction and wear between the guide holes and the steel punches. Further-more, the die block was fabricated of relatively soft steel, so that when the edges of die holes became worn, as a result of friction with the steel punches, the edges of the die holes could be peened slightly closed. Thereafter, the steel punches were then relied on to punch through the peened edges to re-cut the die holes with no clearance. Of course, this imposed additional and undesirable wear on the cutting edges of the punches themselves and required further re-grinding. Obviously, the prior art solutions are limited in effectiveness, are time-consuming, labor intensive, costly and do not contribute to component life.

SUMMARY OF THE INVENTION

The present invention provides an improved die assembly and components therefor for punching one or more holes in a stack of paper sheets. The improved die assembly is especially well-adapted for use in a die press to punch a row of holes along an edge of a stack of paper sheets in response to a single operating stroke (open-close-open) of a drive member in the press.

The die assembly comprises a stationary lower die block having a row of die holes therethrough; a guide plate assembly comprising one or more stationary guide plates, each having a row of guide holes therethrough, located above and spaced from the die block by a separator plate so as to define a stack-receiving slot; a reciprocably movable punch retainer assembly located above the guide plate assembly; and a row of elongated, downwardly-depending punches connected at their head ends to the punch retainer assembly which extend through and slidably engage the guide holes and are receivable in the die holes. When the press closes, the cutting ends of the punches move through the stack-receiving slot and through a stack of sheets therein into sliding engagement with the die holes. When the press opens, the punches are withdrawn clear of the stack-receiving slot.

In accordance with the invention, the head end of each punch is connected to the punch retainer assembly so that it can "float" (i.e. shift axially and/or shift transversely for very small distances). The "float" enables the guide holes in the guide plate(s) to maintain the cutter ends of the punches in precise alignment with the die holes.

The head end of each punch is also connected to the punch retainer assembly so as to prevent the punches from being axially disengaged from the punch retainer assembly during press operation and to prevent the punches from rotating relative to the punch retainer assembly during press operation and during grinding.

The cutting end of each punch has a pair of spaced apart cutting edges separated by an indented surface (hemispherical or wedge-shaped) which bears against the stack during a cutting operation to relieve loads on the cutting edges and thereby extend their life.

The guide plate assembly comprises one or more guide plates, each guide plate having a row of guide holes therethrough. The lateral tolerance between each guide holes and associated punch is extremely small so as to ensure precise guidance during axial movement of the punch therein with respect to the die holes.

Means are provided to reduce friction between the guide holes and the punches. Such means comprise fabrication of each guide plate from graphite steel and/or provision of lubrication means such as a lubricated wick in the guide plate assembly for supplying lubricant to the punches.

The punches, die block and guide plate(s) are fabricated of steel which is selected and heat-treated to provide specific hardness, toughness and wear characteristics.

The lateral tolerance between each punch and its associated guide hole(s) and die hole in which it is slidably received is extremely small to ensure precisely-sized holes in the blank, but this is accomplished with a minimum of friction and wear because of the precise guidance furnished by the guide holes and by the lubrication means in the guide plate assembly.

A die assembly and components therefor in accordance with the invention offer several advantages over the prior art. For example, more cleanly cut holes are provided in the stack of paper sheets, cutting pressure is reduced, friction between components is reduced, less component wear occurs, component life is extended and down-time for servicing and replacement of components is substantially reduced.

Other objects and advantages will hereinafter appear.

DRAWINGS

FIG. 6 is a top plan view of the separator plate of FIG. 1;

FIG. 7 is a side elevation view of the separator plate of FIG. 6;

FIG. 8 is a top plan view of a mounting key, shown in FIGS. 1 and 2, for the main die plate;

FIG. 9 is an end elevation view of the mounting key of FIG. 8;

FIG. 10 is a top plan view of the main guide plate of FIGS. 1 and 2:

FIG. 11 is a side elevation view of the main guide plate of FIG. 10;

FIG. 12 is an end elevation view of the main guide plate of FIGS. 10 and 11;

FIG. 13 is a top plan view of the auxiliary guide plate of FIGS. 1 and 2;

FIG. 14 is an end elevation view of the auxiliary guide plate of FIG. 13;

DESCRIPTION OF PREFERRED EMBODIMENTS

Figure 1:
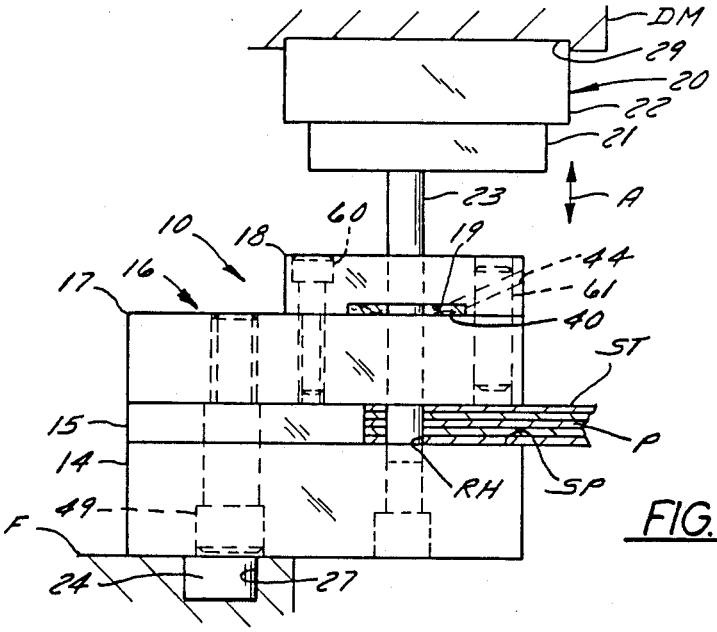
FIG. 1 is an elevation view of one embodiment of a die assembly in accordance with the present invention and showing the components thereof including a die block or plate, a back guage and separator plate, a main guide plate, an auxiliary guide plate, a punch retainer plate and a cap plate.
Figure 2:
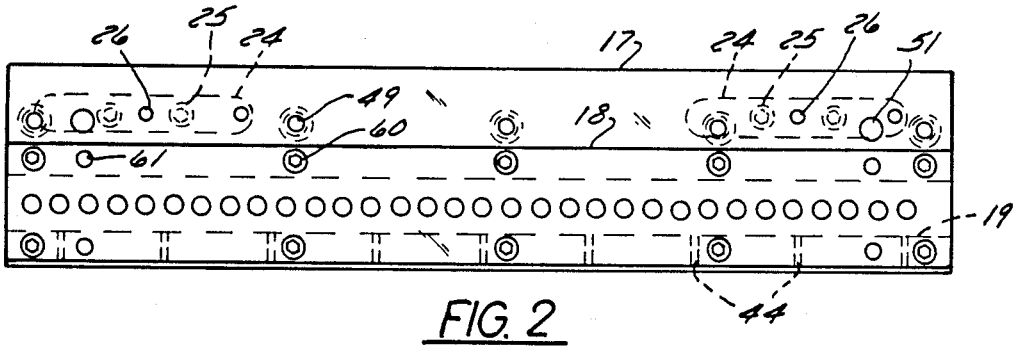
FIG. 2 is a bottom plan view of the die assembly of FIG. 1.
Figure 3:
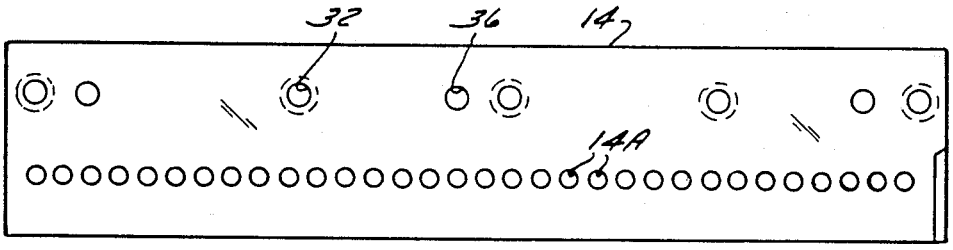
FIG. 3 is a top plan view of the die block of FIGS. 1 and 2.
Figure 5:
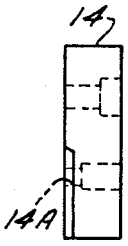
FIG. 5 is an end elevation view of the die block of FIGS. 3 and 4.
Figure 4:
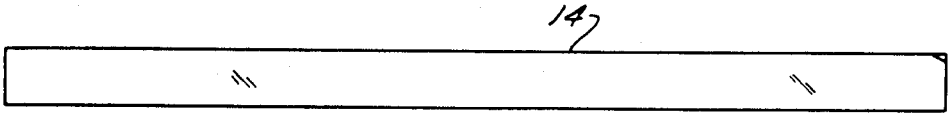
FIG. 4 is a side elevation view of the die block of FIG. 3.

FIGS. 1 and 2 show a die assembly 10 in accordance with the invention which is adapted to be detachably mounted in a die press comprising a stationary frame F and a reciprocably movable drive member DM which may be manually or motor-driven, depending on press size. Die assembly 10, which has a stack-receiving slot SP therein, is operated by the die press to punch a row of holes, such as hole RH, along an edge of a stack ST of paper sheets P. The stack ST, after punching, is intended to be incorporated into a publication or notebook (not shown) by means of a wire or plastic helical coil (not shown) which is threaded through the row of holes RH.

Die assembly 10 generally comprises a stationary die block 14; a stationary separator and containment plate 15; a stationary guide assembly 16 including a main lower guide plate 17 and an auxiliary upper guide plate 18; a reciprocably movable punch mounting assembly 20 including a lower punch mounting plate 21 and an upper cap plate 22; and a row of punches, such as punch 23, mounted on and reciprocably movable with punch mounting assembly 20 in the direction of arrow A (FIG. 1).

Die block 14, separator and containment plate 15, main guide plate 17 and auxiliary guide plate 18 are rigidly secured together by screws 49 and dowel pins 51 and form a stationary unit. Plate 15 separates plates 14 and 17 so as to define stack-receiving slot SP therebetween which receives stack ST which is supported on die block 14 and also defines a straightedge which guides and aligns the stack in proper position before the holes RH are punched.

Lower punch mounting plate 21 and upper cap plate 22 are rigidly secured together by screws 48 and form a reciprocably movable unit on which the punches 23 are mounted. Upper guide plate 18 is provided on its underside with an elongated slot 19 for receiving a flat elongated, lubricant-filled, felt-like wick 40 for lubricating the punches 23. Plate 18 is secured to plate 17 by screws 60 and dowels 61.

As FIG. 1 shows, cap plate 22 of punch mounting assembly 20 is received in a groove 29 formed in movable drive member DM. A pair of keys 24 (see FIGS. 1, 2, 8 and 9) are rigidly secured to the underside of die block 14 by screws 25 and dowels 26 and are received in correspondingly-shaped slots 27 (one shown in FIG. 1) formed in die press frame F and serve to maintain die assembly 10 in properly aligned, fixed position in the die press.

Die plate 14 supports the stack ST of paper as it is cut and its holes 14A provide an exit for paper removed by the punches 23 to make the holes RH. Die plate 14 also provides a cutting edge around each hole 14A for a punch 23 to cut against. The configuration of the stationary unit is such as to fit a cavity in the die press for location and orientation thereof relative to the movable portion, and can be held in place by various clamping devices (not shown).

Punch retainer assembly 20 including a punch retainer plate 21 and a cap plate 22, is disposed adjacent and above guide plate assembly 18 and is relatively movable away from and toward the guide plate assembly in the direction of arrow A (FIG. 1) between open and closed positions, respectively. The row of elongated punches 23 is mounted on and movable by and with punch retainer assembly 20.

The die block 14, guide plates 17 and 18, and punch retainer plate 21 are each provided with a row of die holes 14A, guide holes 17A and 18A, and punch-retainer holes 21A, respectively. The guide holes 17A and 18A guide the punches 23 into precise alignment with the die holes 14A. The punch retainer holes 21A are part of a means for securing the punches 23 on the punch retainer assembly 20. Each hole 14A, 17A and 21A corresponds in shape to the transverse cross-sectional configuration of the punch 23 receivable therein which, for example, may be round, oval, retangular, irregularly-shaped or any other desired configuration, depending on the desired hole shapes for stack ST.

Figure 15:
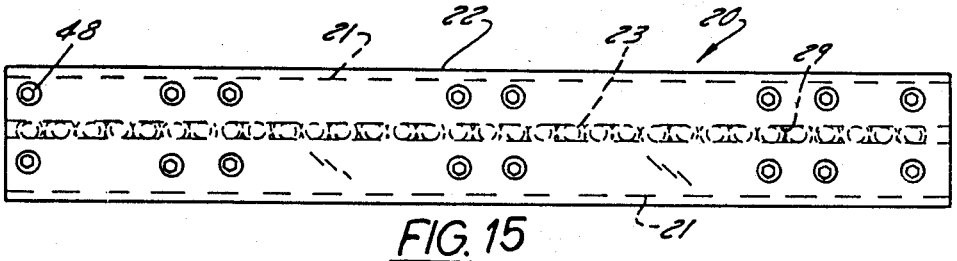
FIG. 15 is a top plan view of a subassembly comprising the cap plate of FIGS. 1 and 2 with the punch retainer plate and punches attached thereto.
Figure 16:
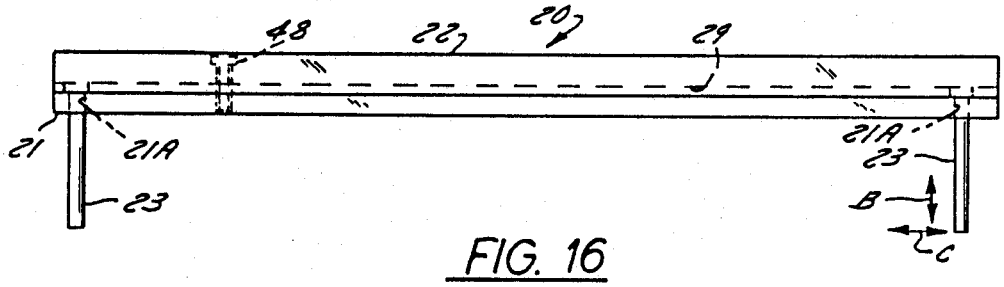
FIG. 16 is a side elevation view of the subassembly of FIG. 15.
Figure 17:
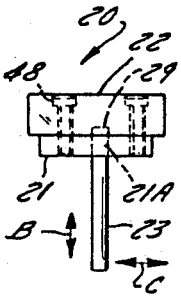
FIG. 17 is an end elevation view of the subassembly of FIGS. 15 and 16.

Referring to FIGS. 15, 16 and 17, each punch 23 takes the form of an elongated member, made of tool steel, which has a head end, a shank and a cutting end. The upper head end is mounted in a punch-retainer hole 21A in punch retainer plate 21. Each punch 23 extends downwardly through and is slidably engaged by the registering guide holes 17A and 18A in the guide plate 17 and 18, respectively. The lower cutting end of each punch 23 is reciprocably movable through stack-slot SP and through a registering die hole 14A in die block 14 as punch retainer assembly 20 and the punches thereon are reciprocably moved by drive member DM of the die press.

Means are provided to attach each punch 23 to punch retainer assembly 20 so that the punch can "float" i.e., move axially and laterally (see arrows B and C, respectively, in FIGS. 16, 17) for very small, limited, specific distances relative to assembly 20 to thereby enable the cutting end of the punch to be guided by respective guide holes 18A and 17A in guide assembly 16 into precise alignment and sliding engagement with a respective die hole 14A to thereby reduce wear on the punch and its associated guide holes and die hole 14A.

Means are also provided to transmit motive force to the punch 23 and also to constrain the punches from unintentional axial withdrawal from punch retainer assembly 20 during punching operations.

Means are also provided to prevent rotation of each punch 23 relative to punch retainer assembly 20 to facilitate initial grinding and subsequent regrinding of a punch or a row of punches to simultaneously sharpen the cutting ends thereof.

The cutting end of each punch 23 is provided with a cutting edge configuration, hereinafter described, which reduces the pressure required to force the punch through a stack ST of paper sheets P to form the hole RH therein.

Thus, as FIGS. 1, 15, 16, 17 and 18 show, each punch 23 has a head or flange 23A on its head end and at least one flat surface 23D is provided on a side edge of the head or flange. As previously described, punch retainer assembly 20 comprises the punch retainer plate 21 having a row of punch retainer holes 21A therethrough and cap plate 22 which is rigidly (but removably) secured as by screws 48 to the outer (upper) side of the punch retainer plate 21A. Cap plate 22 has a longitudinal groove 29 formed on its inner (lower) side for receiving the punch heads 23A and cooperates with punch retainer plate 21 to entrap the heads 23A so as to transmit punching and withdrawal motion to the punches 23 during operation of the die press, to prevent axial withdrawal of the punches while allowing for limited axial "float" travel of the punches in the direction of arrow B for alignment purposes, and to prevent punch rotation. The shank of each punch 23 extends through an associated punch retainer hole 21A in punch retainer plate 21 and the lateral tolerance therebetween is such as to allow for limited lateral "float" travel of the punch in the direction of arrow C in response to guidance provided by the associated guide holes in guide assembly 16 which precisely direct the cutting ends of the punches into and out of the associated die holes 14A in die block 14.

In applications for punches having square, rectangular or irregularly-shaped cross-sectional configurations, the punches may be headless and provided instead with a hardened pin (not shown) extending transversely through the shank of the punch and engaged with the punch retainer plate 21 to secure the punch from pulling action in removing the punches from the stack ST.

The guide assembly 16 guides the punches for proper location and orientation and the lower guide plate 17 thereof acts as a stripper plate to contain the stack ST as the punches 23 are withdrawn from the holes RH which have been cut in the paper. Guide assembly 16 may comprise only one main guide plate such as 17. However, the plate assembly shown provides a space 19 for wick 40 to hold and apply lubricant to the punches and the guide plates. The guide plate assembly 16 shown, which comprises two guide plates 17 and 18 having rows of guide holes 17A and 18A, respectively, therethrough, and the lateral tolerance between each guide hole 17A and 18A and its associated punch 23 is extremely small so as to ensure precise guidance during axial movement of the punch therein.

Means are provided to reduce friction between the guide holes and the punches slidable therein. Such means comprise either graphite steel guide plates 17 and 18 and/or lubrication means for supplying lubricant to the punches and guide holes. Thus, in the embodiment shown the auxiliary guide plate 18 serves as a wick-retainer plate and the longitudinal groove 19 on its inner (lower) side receives the felt-like, lubricant-saturated wick 40 which is entrapped between the plates 18 and 17 and supplies lubricant to the punches 23. A lubricant, such as oil, is provided to wick 40 through oil ports 44 formed in the outer lateral side edge of plate 18A, which ports communicate with the wick groove 19. The guide plates 17 and 18 are both fabricated of graphite steel to further reduce punch friction.

Figure 18:
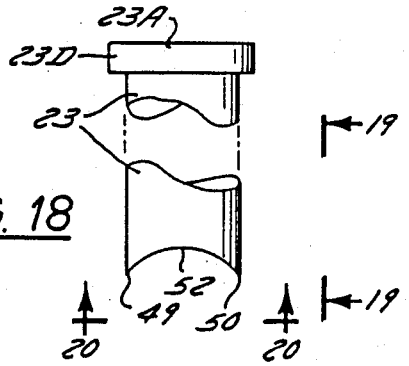
FIG. 18 is an enlarged side elevation view of the cutting end of one embodiment of a punch in accordance with the invention.
Figure 21:
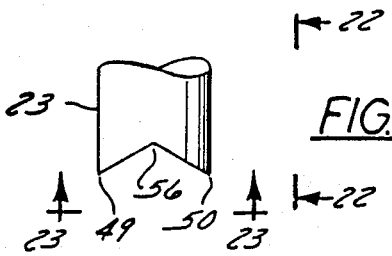
FIG. 21 is an enlarged side elevation view of the cutting end of another embodiment of a punch in accordance with the invention.
Figure 19:
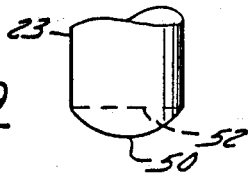
FIG. 19 is a side elevation view taken on line 19—19 of FIG. 18.
Figure 22:
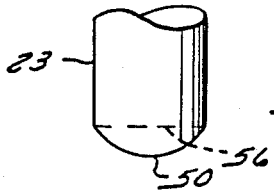
FIG. 22 is a side elevation view taken on line 22—22 of FIG. 21.
Figure 20:
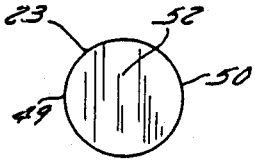
FIG. 20 is an end view taken on line 20—20 of FIG. 18.
Figure 24:
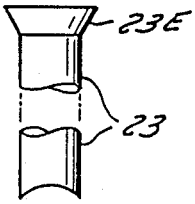
FIG. 24 is a view similar to FIG. 18 of another form of head for the punch.
Figure 23:
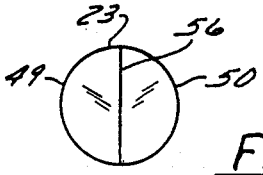
FIG. 23 is an end view taken on line 23—23 of FIG. 21.

As FIGS. 18 through 20 show, the cutting end of each punch 23 is ground or machined to provide two spaced apart opposite cutting edges 49 and 50 with an indented surface 52 therebetween. The indented surface 52 bears upon and exerts compressive pressure on the stack ST during the cutting operation so as to relieve the cutting edges 49 and 50 from having to exert excessive cutting pressure and thereby prolongs punch life and effectiveness. The indented surface 52 may have a hemispherical configuration as shown in FIGS. 16 through 20 or may have an angular cross-sectional configuration as shown in FIGS. 21 through 23 and designated 56.

In one cycle of operation, upper punch retainer assembly 20 and the punches 23 thereon are initially in open or raised position (not shown). The edge of stack ST of paper sheets P is inserted into stack-slot SP. Then, the die press is operated so that its drive member DM moves upper punch retainer assembly 20 and the punches 23 thereon downwardly to closed position (see FIG. 1). As this occurs, the row of punches 23 penetrate stack ST and form a row of holes RH therein (see FIG. 1). The cutting ends of the punches 23 then enter and slidably engage the row of die holes 14A in the lower die block 14 to effect expulsion of the punched-out pieces of paper (not shown) through the open lower ends of the die holes 14A. Thereafter, drive member DM moves the upper punch retainer assembly 20 and the punches 23 thereon upwardly to open position so that the punches retract into the guide holes 17A and are clear of stack-slot or space SP so that the punched stack ST can be removed from the stack-slot, whereupon die assembly 10 and the die press are in readiness for the next cycle of operation.

The punches 23, die block 14 and guide plates 17A and 18A are fabricated of steel which is selected and heat-treated to provide specific hardness and toughness characteristics. The lateral tolerance between each punch 23 and its associated die hole 14 in which it is slidably received is extremely small to ensure precisely sized holes RH in stack ST, but this is accomplished with a minimum of friction and wear because of the precise guidance furnished by the guide holes 17A and 18A in the guide plate assembly 16.

The punches 23 are fabricated of A.I.S.I. type S-7 general purpose tool steel. This material is rough-machined to near final size and heat treated to the following specifications. Preheating to 1200 to 1300 degrees Fahrenheit. Place in a vacuum heat-treat furnace, or a furnace with neutral atmosphere and heat to 1725° and hold at that temperature one hour per inch of thickness of the part. Air quench to 150° F. and then temper at 600° F., for 1 ½ to 2 hours per inch of thickness. This yields a hardness of about 53 to about 55 Rockwell "C", which is best balance of hardness and toughness.

The punches 23 are then ground to finished size in standard grinding machines, taking care to use proper wheels and proper speeds to prevent overheating the punches which could shorten their life or cause warping of the punches. Grinding to tolerances of plus or minus 0.0002" is required.

Punch retainer plate 21 and cap plate 22 can be fabricated of various material depending on the size of the cavity to be fitted and the strength needed. Common materials can be A.I.S.I. type 4140 pre-hardened steel having about 28 to about 32 Rockwell "C" hardness 01 tool steel, either used soft or heat-treated hardened to about 54 to about 58 Rockwell "C" hardness. Tolerances of plus or minus 0.0002" on machining are required to provide 0.0005" to 0.0010" clearance per side between a punch 23 and its locating hole 21A in retainer plate 21 and to provide about 0.001" to about 0.003" vertical float between the head end of the punch 23 and cap plate 22.

Guide plates 17 amd 18 are to be made of A.I.S.I. type A-10 graphite tool steel such as Timken Steel Co. type Graph-air steel. The guide plates are rough-machined to near final size and heat treated to about 60 to about 62 Rockwell "C" hardness and are stablized per standard heat-treat practices. The plates 17 and 18 are then finished to size by grinding or machining by traveling wire electrical discharge machining, holding tolerances of plus or minus 0.0002".

Separator plate 15 can be made of various steel materials, such as type 4140 pre-hardened, 01 tool steel, 54 to 58 Rockwell "C" hardness; or A-2 tool steel, 54 to 58 Rockwell "C" hardness.

Die block 14 is made of A.I.S.I. type A-2 tool steel, rough-machined to near final size, hardened to about 60 to about 62 Rockwell "C" hardness and stablized per commercial heat-treat practices. Die block 14 is finished to size by grinding or machining by traveling wire electrical discharge machining, holding tolerances of plus or minus 0.0002". Clearance between each punch 23 and its die hole 14A is from about 0.0015" to about 0.0025" per side.

I claim:

1. A die assembly for use in a die press to punch a hole in a stack of paper sheets comprising:

a die block having a die hole therethrough;

guide means disposed in spaced apart relationship with respect to said die block so as to define a space for receiving said stack, said guide means comprising two guide plates, each guide plate having a guide hole therethrough, each guide hole being aligned with the other and with said die hole;

a separator and stack containment plate mounted between said die block and one of said guide plates;

lubricating wick means disposed between said two guide plates;

punch retainer means disposed for relative movement away from and toward said guide means between open and closed positions, respectively;

said punch retainer means comprising a punch retainer plate having a punch retainer hole therethrough and a cap plate rigidly secured to said punch retainer plate;

and a punch mounted on said punch retainer means and slidably received in said guide hole, said punch having a head end with a projection thereat entrapped between said cap plate and said punch retainer plate, said punch extending through said punch retainer hole and being axially shiftable and laterally shiftable for relatively small distances within said punch retainer hole to enable said guide holes in said guide plates to precisely align said punch with said die hole as said punch is moved axially by said punch retainer means.

2. A die assembly according to claim 1 wherein one of said cap plate and said punch retainer plate has a groove therein in which said projection on said punch is received and which prevents rotation of said punch relative to said punch retaining hole.

3. A die assembly according to claim 2 wherein said projection takes the form of a head having a flat on one edge.

4. A die assembly according to claim 1 or 2 or 3 wherein said die block is fabricated of AISI type A-2 tool steel pre-machined and heat-treated to harden to about 60 to 62 Rockwell "C" hardness and stabilized;

wherein each of said two guide plates is fabricated of AISI type A-10 graphite tool steel pre-machined and heat-treated to harden to about 60 to 62 Rockwell "C" hardness and stabilized;

and wherein said punch is fabricated of AISI type S-7 general purpose tool steel rough-machined, preheated to about 1200° to 1300° F., placed in an inert atmosphere or vacuum and heated to about 1725° F. for about one hour per inch of thickness, air-quenched to about 150° F. and tempered at about 600° F. for about 1.5 to about 2 hours per inch of thickness to yield a hardness of about 53 to 55 Rockwell "C" hardness.

5. A die assembly according to claim 4 wherein the clearance distance between the opposite sides of said punch and each of said punch retaining hole, each of said guide holes and said die hole is, respectively: about 0.0005" to about 0.0010", about 0.0015 to about 0.0025", and about 0.0015" to about 0.0025".

6. A die assembly according to claim 1 or 2 or 3 wherein each of said die block, said two guide plates and said punch retainer plate have row of said holes, and wherein a row of punches are provided on said punch retainer means.

7. A die assembly for use in a die press to punch a hole in a stack of paper sheets comprising:

a die block having a die hole therethrough;

guide means comprising two guide plates each having a guide hole therethrough and disposed in spaced apart relationship with respect to said die block so as to define a space for receiving said stack and so that said guide hole is aligned with said die hole, said guide means further comprising a lubricating wick disposed between said two guide plates;

punch retainer means disposed for relative movement away from and toward said guide means between open and closed positions, respectively;

and a punch mounted on said punch retainer means and slidably received in said guide hole, said punch being reciprocably movable axially by said punch retainer means through said space and into and out of sliding engagement with die hole, said punch being axially shiftable and laterally shiftable for relatively small distances relative to said punch retainer means to enable said guide hole in said guide plate to precisely align said punch with said die hole as said punch is moved axially by said punch retainer means.

8. A die assembly according to claim 7 wherein said punch has a head end engaged with said punch retainer means, a shank slidably received in said guide holes, and a cutter end for periodic sliding engagement in said die hole; and wherein said cutter end comprises a plurality of laterally spaced apart cutting edges which are separated by a recessed surface which engages and bears against a stack disposed in said space as said cutting edges pierce said stack while said punch retainer moves toward closed position.

* * * * *